United States Patent [19]

Culp

[11] 4,247,364

[45] Jan. 27, 1981

[54] METHOD OF MAKING A SMOOTH, DIMENSIONALLY STABLE, MICA-FILLED, GLASS FIBER SHEET

[75] Inventor: Charles R. Culp, Lancaster, Pa.

[73] Assignee: Armstrong Cork Company, Lancaster, Pa.

[21] Appl. No.: 53,957

[22] Filed: Jul. 2, 1979

Related U.S. Application Data

[63] Continuation of Ser. No. 921,459, Jul. 3, 1978, abandoned.

[51] Int. Cl.[3] ..... B32B 5/16; D21F 11/00

[52] U.S. Cl. ..... 162/136; 162/145; 162/146; 162/168 R; 162/169; 162/181 C; 428/283; 428/324; 428/363; 428/454

[58] Field of Search ..... 428/283, 324, 325, 331, 428/338, 359, 363, 372, 357, 392, 426, 454; 162/145, 146, 149, 152, 156, 157, 163, 164, 166, 167, 169, 181 R, 181 C, 231, 168 R, 138, 139

[56] References Cited

U.S. PATENT DOCUMENTS

| | | | |
|---|---|---|---|
| 2,917,426 | 12/1959 | Bugosh | 162/181 C |
| 3,017,318 | 1/1962 | Labino et al. | 162/152 |
| 3,039,914 | 6/1962 | Reiman | 162/181 C |
| 3,080,272 | 3/1963 | Jackson | 162/181 C |
| 3,108,926 | 10/1963 | Brown | 162/181 C |
| 3,344,016 | 9/1967 | Moggio et al. | 162/146 |
| 3,622,445 | 11/1971 | Heidweiller | 162/145 |
| 3,679,544 | 7/1972 | Ashikaga et al. | 162/146 X |
| 3,749,638 | 7/1973 | Renaud et al. | 162/145 |
| 3,773,513 | 11/1973 | MacClaren | 162/169 X |
| 4,060,451 | 11/1977 | Uchiyama et al. | 162/157 R |

*Primary Examiner*—Lorraine T. Kendell

[57] ABSTRACT

A mica-filled glass fiber sheet which is smooth, of relatively low porosity, and dimensionally stable is described as is its method of manufacture. The sheet is prepared from a low-consistency aqueous slurry wherein the solids consist essentially of glass fibers, organic fibers, mica, and binder. Based on 100 parts by weight glass fibers, 3 to 15 parts by weight organic fibers, 30 to 100 parts by weight mica flakes, and 5 to 20 parts by weight organic binder are added to the water in preparing the furnish. In forming the sheet, this slurry or furnish is deposited onto a moving screen, the excess water is removed, and the wet laid sheet is dried and the binder set. In a subsequent operation, the sheet is saturated with a resin solution or latex.

8 Claims, No Drawings

METHOD OF MAKING A SMOOTH, DIMENSIONALLY STABLE, MICA-FILLED, GLASS FIBER SHEET

CROSS-REFERENCE TO RELATED APPLICATION

This is a continuation of application Ser. No. 921,459, filed July 3, 1978, now abandoned.

BACKGROUND OF THE INVENTION

1. Field of the Invention

The invention relates to a method for producing a smooth, dimensionally stable, low-porosity fiber sheet material particularly suitable as a backing for thermoplastic vinyl resin composition surface coverings.

2. Description of the Prior Art

Glass fiber webs having good dimensional stabilty as well as superior strength characteristics are described in U.S. Pat. No. 3,622,445. Also, porous, self-supporting, mica-containing sheet materials are disclosed in U.S. Pat. No. 3,523,061, and the production of sheet-like products from siliceous stock material, such as glass fibers, ceramic flakes, glass flakes, mica, and the like, are disclosed in U.S. Pat. No. 3,005,745.

SUMMARY OF THE INVENTION

One of the conventional films utilized as a backing for thermoplastic vinyl resin composition decorative surface coverings, such as floor coverings, commonly in use is a beater-saturated asbestos fiber felt, such as that described in U.S. Pat. No. 2,759,813. The use of such felts has proven quite successful in that the backings are essentially moisture impervious, and products formed on such backings may be utilized both on or below grade where moisture conditions might prove deleterious to felt backings based on cellulose or wood fibers or other organic materials which might be adversely affected by moisture.

In recent years, the utilization of asbestos in various products has become suspect. Considerable effort has gone into the design of products which would be equivalent in structural and physical properties but in which the use of the asbestos fibers would be eliminated. Glass fiber webs, being strong yet flexible, rot resistant and dimensionally stable, would appear to be suitable and, for example, the glass fiber webs described in U.S. Pat. No. 3,622,445 would appear to possess the desirable properties for use as replacements for the beater-saturated asbestos fiber felts such as that described in U.S. Pat. No. 2,759,813. Typically, however, glass, organic fiber felts, are of an open, porous nature due to the manner in which the "toothpick"-like fibers orient and pack themselves.

I have discovered that a backing sheet may be formed which is of a low porosity and which is smoother than conventional glass fiber-containing felt. This sheet is formed by incorporating a significant amount of mica flakes in the slurry composition utilized for forming the sheet. Generally, I prepare a glass fiber containing slurry of low consistency wherein the solids consist essentially of, based on 100 parts by weight glass fibers, 3 to 15 parts by weight organic fibers, 30 to 100 parts by weight mica flakes, and 5 to 20 parts by weight organic binder, preferably in the form of heat reactable fibrous material. This slurry is sheeted out on conventional paper-forming equipment such as a Rotoformer (Sandy Hill Corporation) or an inclined Fourdrinier, excess water is drained and the resultant sheet material is dried and the binder set. As a last step, the sheet thus formed is saturated with a melamine, styrene-butadiene rubber latex which may be filled with conventional fillers such as limestone and which may be pigmented with conventional pigments such as titanium dioxide.

DESCRIPTION OF THE PREFERRED EMBODIMENTS

In accordance with this invention, a water slurry is first formed by adding glass fibers, synthetic resin fibers, small amounts of binder such as poly(vinyl alcohol) fibers and mica flakes, together with a conventional dispersant such as sodium lauryl sulfate. Generally speaking, the percent by weight of solids in the slurry is maintained at about 0.75%, preferably between 0.5% and 1.0%. This slurry is maintained at a pH of from about 2.5 to 3.0 by the addition of sulfuric acid. Prior to flowing the slurry out onto the wire of the paper-forming machine, it is diluted to a consistency between about 0.01% and 0.05%, or usually about 0.02%. A distinct advantage of the furnishes of my invention is that they provide for rapid drainage of water on the forming machine, allowing for relative rapid forming rates. As water is drawn from the furnish on the wire of the Rotoformer or inclined Fourdrinier, a web forms which, on further draining, is then dried under sufficient heat to activate the binder and form a self-sustained sheet of about 3 to 7 ounces per square yard. The dried sheet is thereafter saturated with a resin such as a latex formed from a styrene-butadiene rubber latex to which filler may have been added, together with small amounts of pigment, if desired, and the saturated sheet is thereafter cured to form the desired backing material.

In forming the slurry, we have found the glass fibers of high strength formulations low in alkali and having a diameter of 3 to 15 microns and generally an average diameter of about 6 microns and an average length of approximately $\frac{1}{4}$-$\frac{1}{2}$ inch may be utilized. Typically, the fibers are produced from alkali-free E glass. Such fibers generally have tensile strengths of about 500,000 p.s.i. at 72° F. and moduli of elasticity of about $10.5\times10^6$ p.s.i.

Synthetic organic fibers, such as polyester fibers, polypropylene fibers, acrylic fibers, acetate fibers, and other commercially available fibers such as poly(vinyl chloride) and polyamides such as nylon are suitable for the organic fiber portion of the furnish. The synthetic organic fibers utilized in forming the slurry preferably have an average length of from about $\frac{1}{4}$-$\frac{1}{2}$ inch and deniers between about 1 and 6.

Although it will be readily evident that any typical organic binder commonly used in paper making may be used, we prefer the use of poly(vinyl alcohol) fibers since they seem to assist in good sheet formation.

The mica flakes suitable for use in the present product are of 20 to 100 mesh (U.S. Standard Sieve). Preferably, the mica flakes are of 60 to 100 mesh.

All of the above ingredients are dispersed in water to form a slurry or furnish by adding up to 2% by weight, based on the weight of the solids, of a surface active dispersant, such as sodium lauryl sulfate or trimethylene diamine. Preferably, the slurry is maintained at a pH below about 4.0 and preferably from about 2.5 to 3.0, and the pH is controlled by metering into the slurry sufficient sulfuric acid to maintain it at the desired pH.

Preferably an aqueous melamine-synthetic rubber latex is utilized for saturating the paper and contains a styrene-butadiene rubber latex, a water emulsion containing about 50% by weight solids, and melamine in a weight ratio of styrene-butadiene rubber to melamine of from about 6:1 to 10:1 dry solids. This latex is preferably unfilled, although conventional inorganic fillers such as limestone may be added together with, if desired, small amounts of conventional inorganic pigments, for instance, titanium dioxide. Other latexes such as the acrylics and acrylonitrile and even water solutions of thermosetting resins such as phenolics and urea or melamine formaldehydes might also be used although the melamine-styrene-butadiene rubber latex is preferable for resilient flooring applications.

In accordance with my process, the paper sheet as it comes from the forming machine is transferred to can driers where drying takes place simultaneous with the conversion of the poly(vinyl alcohol) fibers to a binder. This action takes place since the poly(vinyl alcohol) fiber dissolves in the hot water, formed on contact with the drier, at approximately 80° C. and thus coats the glass fibers so as to yield a sheet weighing between 3 to 7 ounces per square yard, which is of sufficient strength to pass through a sizing press. At the size press, the latex saturant is added to a glass sheet with saturation being carried out to the extent of from about 30% to up to 100% pick-up dry weight of latex solids based on the weight of the glass paper. After the size press, the saturated sheet is then dried, wound up on a core, and removed to a slitting operation to trim to the desired width.

The following example will illustrate a specific embodiment of this invention.

As aqueous slurry is prepared by mixing fibers and mica flakes with water at a consistency of about 0.75% by weight solids. Of the solids: 100 parts by weight are glass fibers having an average diameter of about 6 microns and an average length of about ¼ inch manufactured of a high strength, alkali-free glass (E-glass); 4.0% by weight are synthetic polyester fibers having a denier of about 1.5 and a length of about ¼ inch; 15.8 percent are poly(vinyl alcohol) fibers having a denier of about 1.0 and a length of about ¼ inch and the balance of the solids are 70.9 parts by weight mica flakes (60 mesh, U.S. Standard Sieve). About 1.0 part by weight sodium lauryl sulfate is added to aid in dispersing the solids in the slurry. Sulfuric acid is metered in to maintain the pH of the dispersion at about 2.5. A conventional dispersion tank is used for slurrying and to contain the prepared slurry. The slurry is pumped to a machine chest just prior to sheet formation and is further diluted to a solids level of about 0.02% by weight just prior to flowing the slurry onto the paper making wire of a rotary paper making machine.

In forming the glass fiber mica filled sheet, the sheet is transferred from the forming wire to can driers where drying takes place simultaneously with conversion of the poly(vinyl alcohol) fibers to a binder. Completion of the drying on the first set of can driers yields a sheet which is of sufficient strength to pass through a sizing press.

At the size press, the sheet is saturated with a melamine modified synthetic rubber latex having 50% by weight solids of a styrene-butadiene rubber of approximately 50% by weight styrene. Sufficient melamine is added to give a weight ratio of styrene-butadiene rubber to melamine of approximately 6:1. At the size press, the latex is added to the mica filled glass fiber sheet with saturation being carried out to the extent of about 66% pick-up dry weight of latex based on the weight of the mica filled glass fiber paper. The saturated sheet is then dried at 300° to 320° F., wound up on a core, and removed to a slitting operation to trim to the desired width, in this case a width of 76 inches. The breaking strength of the saturated sheet is about 96 pounds per inch of width at 74° F. and about 61.5 pounds per inch of width at 350° F. It has an air flow resistance of 35 cubic feet per minute per square foot under a differential pressure of ½ inch of water when measured in accordance with ASTM D-726-58.

To show the effect of varying mica content to glass fiber content, a series of post saturated mica modified glass fiber hand sheets were prepared and tested in accordance with ASTM D-726-58. The glass, polyester, and poly(vinyl alcohol) fibers and mica flakes used were the same as in the example set out above, with the exception that 20 mesh mica flakes were employed. Each handsheet was saturated to about a 66% pick-up dry weight of latex based on the weight of the mica filled glass fiber handsheet using the above described melamine/SBR latex. As clearly indicated by the results set out in the table below, the level of mica is critical to porosity.

Table I

| Parts by Weight Mica Based on 100 Parts By Weight Glass Fibers | Air Flow Resistance (Cubic feet per minute per square foot - ½ inch water column) |
|---|---|
| 0 | 83.2 |
| 10 | 64.3 |
| 20 | 45.8 |
| 30 | 31.1 |
| 40 | 29.9 |
| 67 | 20.9 |
| 100 | 6.76 |

Sheets having satisfactory porosity lie at mica levels between 30 parts by weight mica flakes and 100 parts by weight mica flakes per 100 parts by weight glass fibers. Such sheets prevent liquids such as plastisols and organosols from being absorbed during plastic sheet processing typically utilized in resilient flooring manufacture. The sheets also minimize adhesive wicking during installation.

I claim:

1. A method of making a smooth, dimensionally stable mica-filled, glass fiber sheet having low porosity comprising:

(a) preparing without prepulping an aqueous slurry having a pH below about 4.0 consisting essentially of glass fibers and, based on 100 parts by weight glass fibers, from 3 to 15 parts by weight organic fibers, 30 to 100 parts by weight mica flakes, and 5 to 20 parts by weight binder;

(b) diluting the slurry to a consistency between about 0.01% and 0.05% by weight solids; and (c) depositing said slurry onto a moving screen, removing the excess of water to form a water laid sheet, and drying the sheet to set the binder.

2. The method in accordance with claim 1 in which the glass fibers have diameters in the range of 3–15 microns, an average length of ¼ to ½ inch and are of a low alkali content, the mica flakes having size ranging from 20 to 100 mesh, and the organic fibers are of an average length between about ¼ and ½ inch and deniers between about 1 and 6.

3. The method of claim 2 in which the organic fibers are polyester fibers and in which the binder is poly(vinyl alcohol) fibers which dissolve during the drying step.

4. The method in accordance with claim 2 in which the sheet is post saturated with from about 30% to 100% dry weight pick-up of an organic resin and cured.

5. The method in accordance with claim 4 in which the organic resin is melamine modified styrene-butadiene latex having a melamine to styrene-butadiene weight ratio of from about 1:6 to 1:10.

6. A mica filled glass fiber web of low porosity consisting essentially of 100 parts by weight of low alkali content glass fibers having diameters in the range of 3-15 microns and an average length of ¼ to ½ inch; from 3-15 parts by weight synthetic organic fibers of an average length of ¼ to ½ inch and deniers between about 1 and 6; 30 to 100 parts by weight mica flakes of a size range between about 20 and 100 mesh; and 5 to 20 parts by weight binder.

7. The web in accordance with claim 6 in which the synthetic organic fibers are polyester fibers and in which the binder is poly(vinyl alcohol).

8. The web in accordance with claim 6 or 7 wherein the web has been post saturated and cured with from about 30% to 100% dry weight pick-up of an organic resin.

* * * * *